US008734123B2

(12) United States Patent
Alfayad et al.

(10) Patent No.: US 8,734,123 B2
(45) Date of Patent: May 27, 2014

(54) CONVERTER FOR CONVERTING MECHANICAL ENERGY INTO HYDRAULIC ENERGY AND ROBOT IMPLEMENTING SAID CONVERTER

(75) Inventors: Samer Alfayad, Bourg la Reine (FR); Fathi Ben Ouezdou, Bourg la Reine (FR); Fayçal Namoun, Courbevoie (FR)

(73) Assignee: BIA, Conflans Ste Honorine (FR)

( * ) Notice: Subject to any disclaimer, the term of this patent is extended or adjusted under 35 U.S.C. 154(b) by 695 days.

(21) Appl. No.: 12/934,592

(22) PCT Filed: Mar. 25, 2009

(86) PCT No.: PCT/EP2009/053553

§ 371 (c)(1),
(2), (4) Date: Dec. 15, 2010

(87) PCT Pub. No.: WO2009/118366

PCT Pub. Date: Oct. 1, 2009

(65) Prior Publication Data

US 2011/0085922 A1 Apr. 14, 2011

(30) Foreign Application Priority Data

Mar. 26, 2008 (FR) ..... 08 51943

(51) Int. Cl.
*F04B 1/07* (2006.01)

(52) U.S. Cl.
USPC ..... 417/221

(58) Field of Classification Search
USPC ..... 417/218, 219, 221, 273; 92/72; 91/497
See application file for complete search history.

(56) References Cited

U.S. PATENT DOCUMENTS

| | | | | |
|---|---|---|---|---|
| 3,910,162 | A | | 10/1975 | Nonnenmacher |
| 4,420,812 | A | * | 12/1983 | Ito et al. ..... 700/252 |
| 4,598,628 | A | * | 7/1986 | Courtright ..... 91/481 |
| 4,601,641 | A | | 7/1986 | Kuroyanagi et al. |
| 5,249,512 | A | * | 10/1993 | Christenson ..... 91/491 |
| 5,752,427 | A | * | 5/1998 | Leutner ..... 91/497 |
| 5,944,493 | A | * | 8/1999 | Albertin et al. ..... 417/273 |

FOREIGN PATENT DOCUMENTS

| | | |
|---|---|---|
| DE | 41 43 152 A1 | 7/1993 |
| DE | 195 13 987 A1 | 10/1996 |
| EP | 1 293 667 A1 | 3/2003 |

* cited by examiner

*Primary Examiner* — Bryan Lettman
(74) *Attorney, Agent, or Firm* — Baker Hostetler LLP

(57) ABSTRACT

A converter for converting mechanical energy into hydraulic energy and a robot implementing the converter are disclosed. The converter includes a shaft rotated about a first axis relative to a casing, a hub defining a bore about a second axis, the shaft rotating in the bore. The first axis is parallel to the second axis, and a distance between the first axis and second axis defines an eccentricity. At least two pistons are movably disposed in radial housings of the shaft with the at least two pistons bearing against the bore. Movement of the pistons feed a hydraulic fluid into one of two annular grooves of the casing arranged in an arc of a circle about the first axis, and the hub is configured to translate along a third axis to modify the value of the eccentricity between two extreme values.

14 Claims, 19 Drawing Sheets

CONVERTER FOR CONVERTING MECHANICAL ENERGY INTO HYDRAULIC ENERGY AND ROBOT IMPLEMENTING SAID CONVERTER

CROSS-REFERENCE TO RELATED APPLICATIONS

This application is a National Stage of International patent application PCT/EP2009/053553, filed on Mar. 25, 2009, which claims priority to foreign French patent application No. FR 08 51943, filed on Mar. 26, 2008, the disclosures of which are incorporated by reference in their entirety.

BACKGROUND

The invention relates to a converter for converting mechanical energy into hydraulic energy and to a robot implementing said converter. The invention can be particularly used in the production of humanoid robots in which autonomy is to be improved.

Such robots are equipped with actuating mechanisms that allow the different parts of the robot to be moved. These mechanisms connect a power source providing mechanical energy such as, for example, an electric, hydraulic or pneumatic motor, to a load. In other words, an actuating mechanism transmits mechanical power between a motor and a load.

An essential parameter of an actuating mechanism is its transmission ratio which is chosen so as to adapt a nominal working point of the load to that of the motor. In a known actuating mechanism in which the transmission ratio is constant, formed for example from a set of gears, the choice of the ratio is limited to discrete values and changing the ratio necessitates complicated devices such as a gearbox to adapt the transmission ratio. Now, in robotic applications, the working point of the loads is generally highly variable. If the reduction ratio is constant, this means that the motor must be dimensioned for the most unfavorable circumstances in which the load is used.

Devices exist which allow the transmission ratio to be varied continuously but these are complicated and their performance is often poor. Belt speed reducers are known, for example, whose transmission ratio is varied as a function of the speed of the motor by means of inertia masses.

The above-described actuating devices are bulky, heavy and complex, which is disadvantageous for robotic applications.

Moreover, of the abovementioned motors, electric motors are well suited only to high speeds and low torques. In robotic applications, the opposite situation is common: low speed and high torque. The use of electric motors for low speeds entails high reduction ratios that are thus complicated to achieve.

As is known, in robotic applications, a central hydraulic power unit is used that is connected to different joints to be driven by lines transporting a pressurized fluid. When the robot includes a large number of actuators, the network of lines becomes complex. Moreover, the hydraulic power unit must provide to all the joints the maximum pressure required by the joint that is subject to the greatest demand.

SUMMARY OF THE INVENTION

The invention aims to overcome all or some of the abovementioned problems by providing an actuating mechanism that converts the mechanical energy supplied by a motor into hydraulic energy used by a load, for example in the form of a cylinder allowing a movable part of a robot to be moved. It is understood that the invention is not limited to the field of robotics. The invention can be applied in any field where an actuating mechanism needs to be optimized. More precisely, the invention provides a converter for converting mechanical energy into hydraulic energy which can be decentralized, in other words associated with a single load. The converter then supplies only the hydraulic power required by the load.

To this end, the subject of the invention is a converter for converting mechanical energy into hydraulic energy, including a shaft rotated by mechanical energy about a first axis relative to a casing, a hub comprising a bore formed about a second axis, the shaft rotating in the bore, the two axes being parallel and a distance between the axes forming an excentricity, at least two pistons each capable of movement in a radial housing of the shaft, the housings guiding the pistons, the pistons bearing against the bore, characterized in that the movement of the pistons feeds a hydraulic fluid into two annular grooves of the casing, the grooves being arranged in an arc of a circle about the first axis, the hydraulic energy being generated by a pressure difference of the fluid present between the two grooves, and in that the hub is capable of translation along a third axis perpendicular to the first two axes in order to modify the value of the excentricity between two extreme values, one being positive and the other being negative, so as to generate an inversion of the fluid pressures in the grooves while maintaining the same rotation direction for the shaft.

One of the grooves forms the inlet and the other forms the discharge of the converter. Inverting the fluid pressures between the grooves has the effect of switching the roles of the grooves between inlet and discharge while maintaining the same rotation direction for the shaft.

The subject of the invention is also a robot including multiple independent joints moved by hydraulic energy, characterized in that it also includes the same number of converters according to the invention as there are independent joints, each converter being associated with one joint.

BRIEF DESCRIPTION OF THE DRAWINGS

The invention will be better understood and other advantages will become apparent upon reading the detailed description of several alternative embodiments given by way of example, which description is illustrated by the attached drawings, in which:

FIGS. 16*a* and 16*b* show different positions of a movable part of the second distributor of the second alternative embodiment.

For greater clarity, the same elements carry the same reference numerals in the different figures.

DETAILED DESCRIPTION

Figure 1:
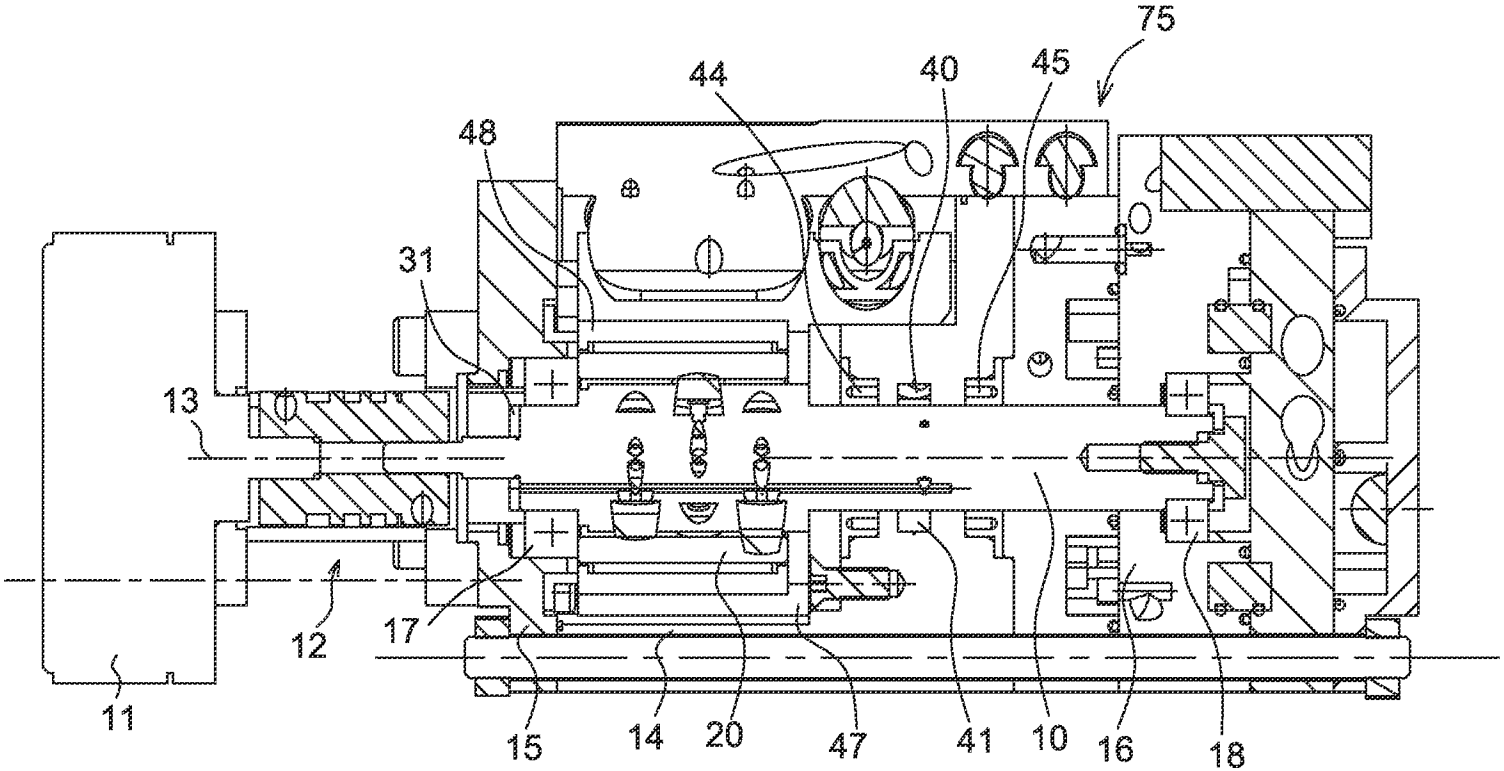
FIG. 1 shows a cross section of an embodiment of a converter according to the invention.

The converter shown in FIG. 1 receives mechanical energy in the form of a rotational movement of a shaft 10 driven by a motor 11, for example a DC electric motor. The motor 11 rotates at a constant rotational speed, which makes it possible to optimize its operation. The shaft 10 is connected to the motor 11 by a coupling 12. It is also possible to dispense with the coupling 12 by forming stator windings of the motor 11 directly on the shaft 10. The shaft 10 rotates about an axis 13 relative to a casing 14 that is closed at the ends of the shaft 10 by two covers 15 and 16. In each cover 15 and 16, a rolling bearing 17 and 18, respectively, effects the guiding, limits the friction between the shaft 10 and the assembly formed by the casing 14 and the covers 15 and 16, and seals the converter.

Figure 2:
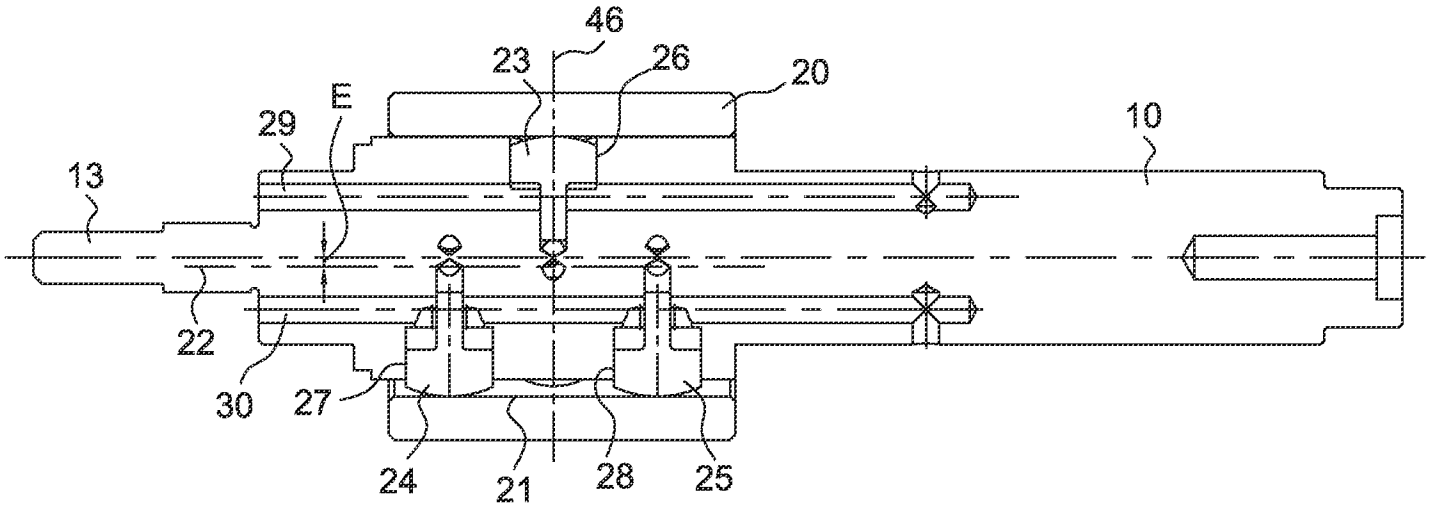
FIG. 2 shows elements that carry out the pumping of a hydraulic fluid, for the converter in FIG. 1.

FIG. 2 shows elements of the converter that effect the pumping of a hydraulic fluid. To this end, the converter includes a hub 20 comprising a bore 21 formed about a second axis 22. The shaft 10 rotates in the bore 21. The two axes 13 and 22 are parallel and a distance between the axes 13 and 22 forms an excentricity E.

The converter includes at least two pistons each capable of movement in a radial housing of the shaft. It is possible to implement the invention for a converter in which the pistons are parallelepipedal vanes. In the example shown, the housings are cylinders and three pistons 23, 24 and 25 each move in a cylinder 26, 27 and 28, respectively. One end of each piston bears against the bore 21. The shaft 10 includes at least two channels that extend parallel to the axis 13. The two channels 29 and 30 can be seen in FIG. 2. The cylinder 26 opens into the channel 29 and the cylinders 27 and 28 open into the channel 30. The number of pistons per channel can be increased until they occupy the entire volume of the shaft 10 lying inside the bore 21.

The pistons are advantageously arranged in a quincunx pattern about the axis 13. In other words, between two adjoining channels, the longitudinal position along the axis 13 of a cylinder opening into a first channel is interposed between the longitudinal positions of two adjacent cylinders of the second channel. This arrangement makes it possible to maximize the number of pistons for a given bore 21. The arrangement improves the dynamic balance of the shaft 10 and of its pistons when the shaft 10 is rotating. The arrangement also reduces the variation in the radial forces on the shaft 10 as a function of the angle of rotation of the shaft 10.

The movement of the pistons 23, 24 and 25 feeds a hydraulic fluid into the channels 29 and 30. More precisely, in the relative position of the shaft 10 and the hub 20 shown in FIG. 2, the pistons 24 and 25 are in a position termed top dead center and the piston 24 is in a position termed bottom dead center. When the shaft 10 rotates about its axis 13, the pistons 23 to 25 move in their respective cylinder between their two dead centers. This movement feeds the fluid present into the part of the cylinders 26, 27 and 28 communicating with the channels 29 and 30. Each channel 29 and 30 is closed off at one of its ends by a cap 31, which can be seen in FIG. 1, and communicates with inlet and discharge orifices at its other end, which orifices will be described later.

Figure 3:
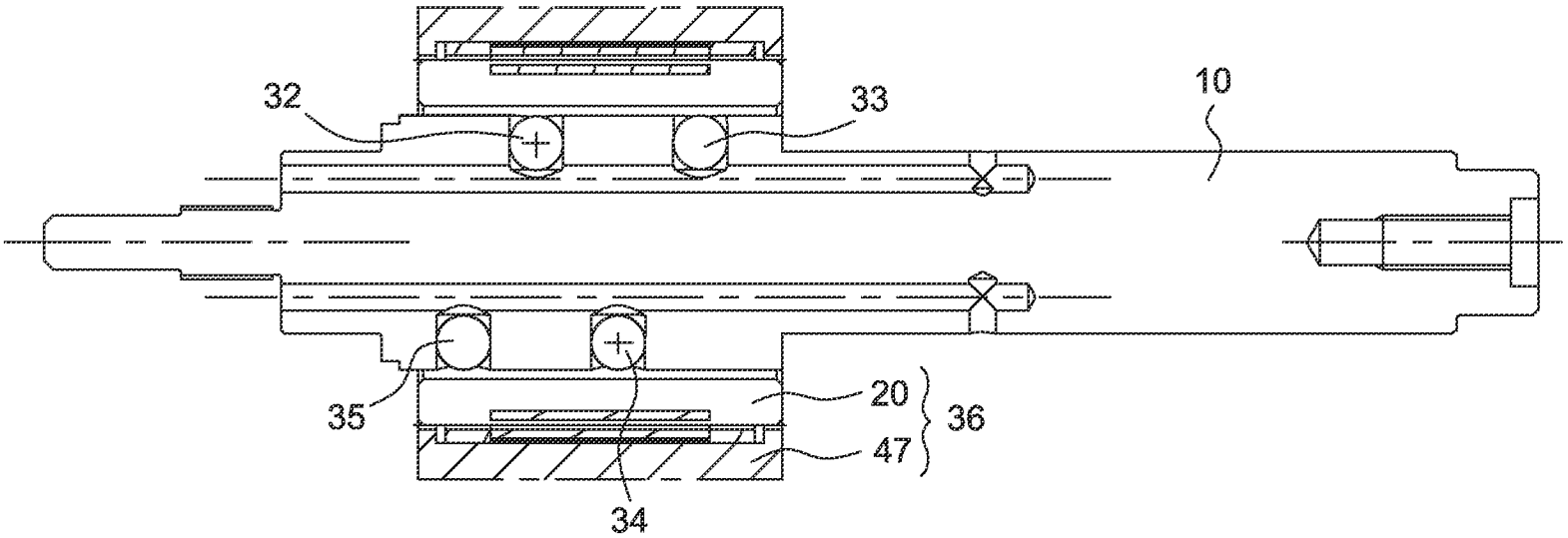
FIG. 3 shows an alternative embodiment of the elements shown in FIG. 2.

FIG. 3 shows an alternative embodiment of the elements shown in FIG. 2, in which embodiment the pistons 23, 24 and 25 are replaced by balls 32 to 35. The diameter of the balls matches the internal diameter of the corresponding cylinders. In the description that follows, the term piston will be used indiscriminately to refer to cylindrical pistons as shown in FIG. 2 or balls as shown in FIG. 3. The use of balls does not allow as good a sealing of the fluid in the cylinders owing to the reduced contact surface area between balls and cylinders. The performance of the converter is reduced as a result. Nevertheless, the alternative embodiment employing balls is much less expensive to produce.

The hub 20 advantageously forms an inner ring of a rolling bearing 36, for example a needle bearing. The hub 20 can thus rotate together with the shaft 10 and so limit the friction of the pistons against the bore 21.

Figure 4:
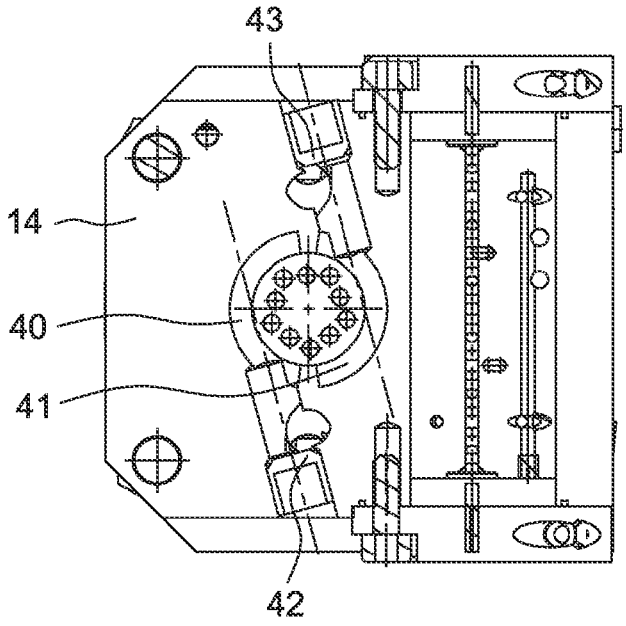
FIG. 4 shows fluid inlet and discharge orifices of the converter.

FIG. 4 shows fluid inlet and discharge orifices of the converter in cross section along a plane perpendicular to that of FIGS. 1 to 3. More precisely, the shaft 10 includes ten longitudinal channels, including the channels 29 and 30. The casing 14 includes two annular grooves 40 and 41 in the shape of an arc of a circle about the axis 13 and each communicating alternately with the channels of the shaft 10. The groove 40, for example, admits the fluid to the channels facing it and, similarly, the groove 41 discharges the fluid to the channels facing it. Each of the grooves 40 and 41 communicates with a connecting socket 42 and 43, respectively, that makes it possible to supply a load associated with the converter either directly or via a distributor which will be described below. For a given excentricity E, the converter operates as a positive displacement pump with a constant output, assuming that the rotational speed of the shaft 10 is constant. The hydraulic energy generated by the converter is caused by a pressure difference of the fluid present between the two grooves 40 and 41. Two seals 44 and 45, which can be seen in FIG. 1 and are, for example, lip seals, can be placed one on either side of the grooves 40 and 41 along the shaft 10 in order to seal the two grooves 40 and 41.

The hub 20 can move in translation along an axis 46 perpendicular to the axes 13 and 22 in order to modify the value of the excentricity E between two extreme values, one being positive and the other being negative. In order to move the hub 20 in translation, an outer ring 47 of the rolling bearing 36 is integral with a carriage 48 capable of moving along the axis 46 in order to modify the value of the excentricity E. Assuming that the rotational speed of the shaft 10 is constant, when the excentricity E is zero, in other words when the axes 13 and 22 coincide, the pistons are stationary in their respective cylinder and the converter delivers no fluid output. When the value of the excentricity E is increased in a first direction along the axis 46, the output of the converter increases. On the other hand, when the value of the excentricity E is increased in a second direction opposite to the first, the output of the converter becomes negative. In other words, the groove 40 switches from inlet to discharge and vice versa for the groove 41. Varying the excentricity E between a positive value and a negative value makes it possible to reverse the inlet and discharge roles of the converter without having to reverse the direction of rotation of the motor 11 to do so. Adjusting the excentricity E makes it possible to use a motor that is very simple to control in order to rotate the shaft 10. This motor can rotate at an almost constant speed without any precise speed control, which simplifies the control of said motor. With this type of motor, the converter output is adjusted just by varying the excentricity E. The inlet/discharge reversal is made much more quickly by varying the excentricity E than by reversing the direction of rotation of the motor owing to the very low inertia of the carriage 48 compared with that of the conventional motor and pump assembly.

It is of course possible, if necessary, to adjust both the excentricity E of the converter and the speed of the motor in its operating range.

Figure 5:
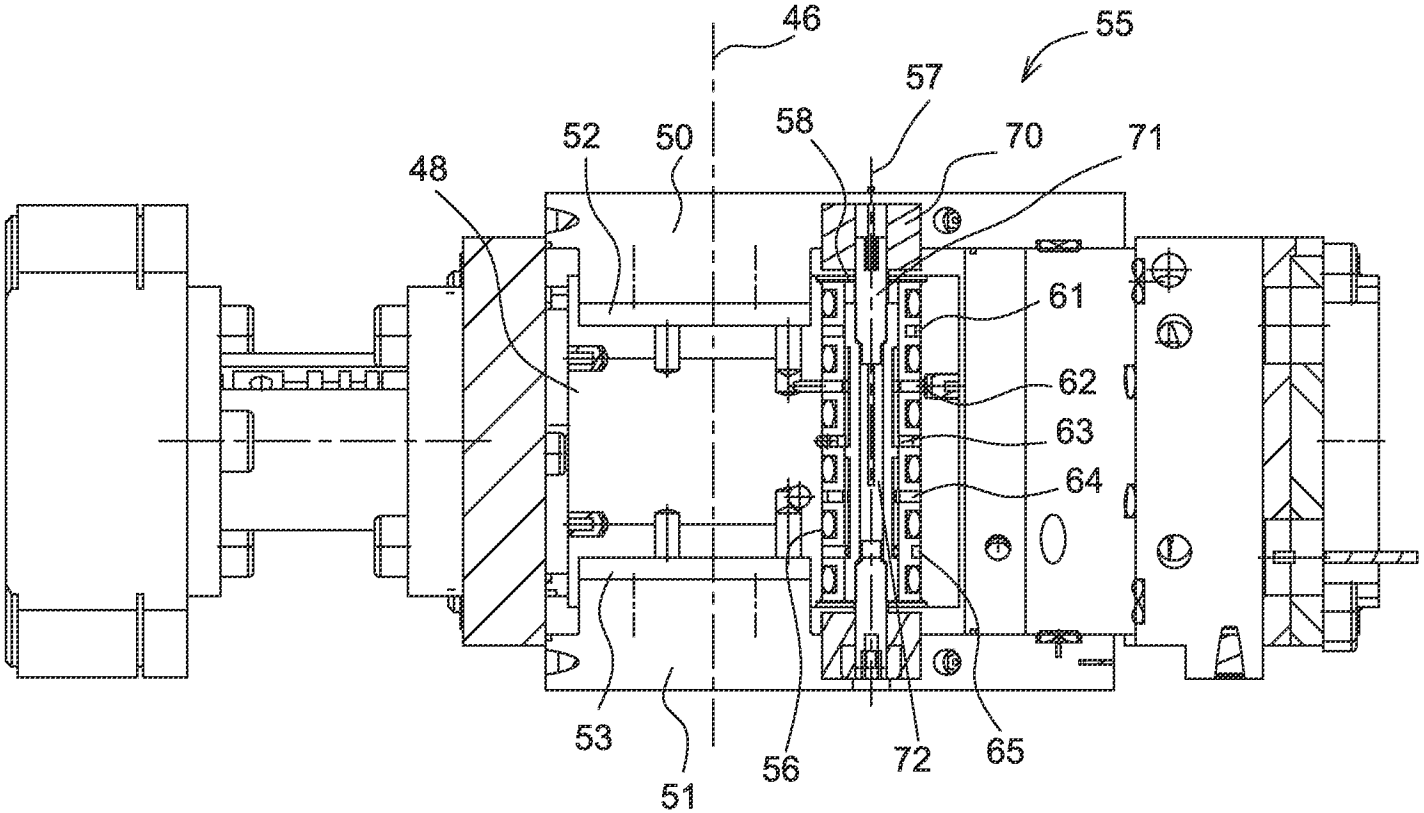
FIG. 5 shows means for modifying an excentricity of the converter.

FIG. 5 is a cross sectional view of the converter along a plane parallel to the plane of FIG. 1. In order to move the carriage 48 in translation along the axis 46, the converter includes two pistons 50 and 51 integral with the casing 14. The pistons 50 and 51 guide and move the carriage 14 along the axis 46. A chamber 52 and 53, respectively, is formed on either side of the carriage 48, between the pistons 50 and 51 and the carriage 48. A differential pressure of a fluid between the two chambers 52 and 53 allows the carriage 48 to be moved in order to modify the excentricity E of the converter.

To this end, the converter includes a valve 55 controlling the movement of the carriage 48 by means of a pressure difference of a hydraulic fluid.

Figure 6:
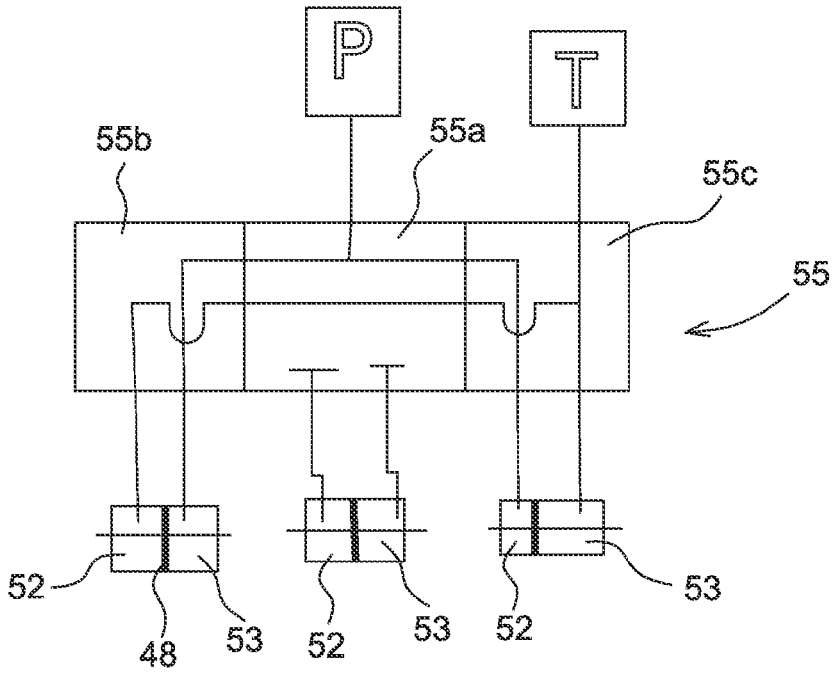
FIG. 6 shows a hydraulic diagram of a valve of the converter.

A hydraulic diagram of the valve 55 is shown in FIG. 6. The valve 55 forms a hydraulic distributor supplied by the fluid moving the carriage 48. A high pressure of this fluid is labeled P and a low pressure is labeled T in FIG. 6. The distributor can assume three positions. In a central position 55*a*, neither of the two chambers 52 and 53 is supplied with the fluid. In a position 55*c*, shown on the right-hand side in FIG. 6, the chamber 53 receives the low pressure T and the chamber 52 receives the high pressure P. In a position 55*b*, shown on the left-hand side in FIG. 6, the chamber 52 receives the low pressure T and the chamber 53 receives the high pressure P.

The valve 55 is advantageously formed in the carriage 48. All the channels supplying the chambers 52 and 53 from the valve 55 are thus formed in the carriage 48, which frees up space in the casing 14. The converter is thus more compact.

The valve 55 includes a bore 56 formed in the slide 48. The bore is made along an axis 57 parallel to the axis 46. The diameter of the bore 56 is constant. The valve 55 includes a rod 58 which can slide inside the bore 56. The outer surface of the rod 58 is formed from alternating cylindrical shapes of a small diameter d and of a large diameter D that extend along the axis 57. A series of five cylindrical shapes is arranged along the axis 57. These shapes have, in order, the diameters D, d, D, d and D. The diameter D is matched to the internal diameter of the bore 56. Two communication chambers 59 and 60 are formed between the bore 56 and the shapes of diameter d. Five channels 61 to 65 formed in the bore 56 enable the fluid to communicate with the chambers 59 and 60. The channels 61 and 65 are connected to the low-pressure fluid T. The channel 62 is connected to the chamber 52. The channel 63 is connected to the high-pressure fluid P and the channel 64 is connected to the chamber 53.

Figure 7A:
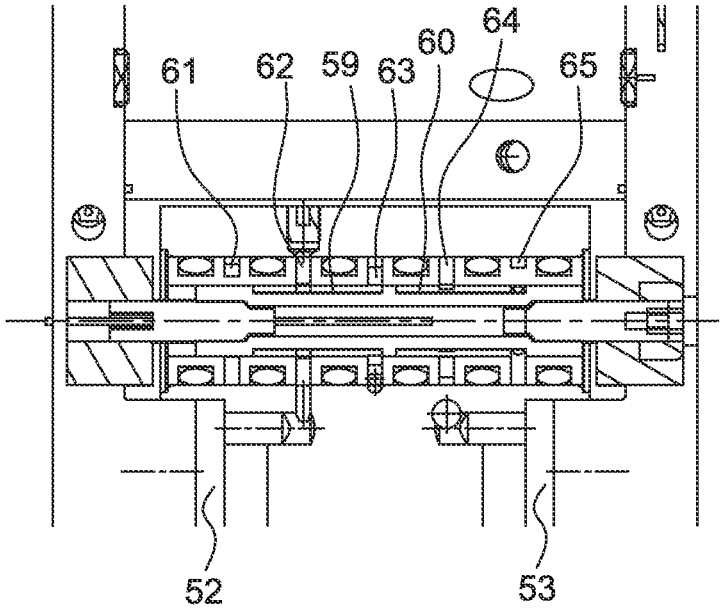
FIGS. 7*a* and 7*b* show two positions of the means for modifying the excentricity.
Figure 7B:
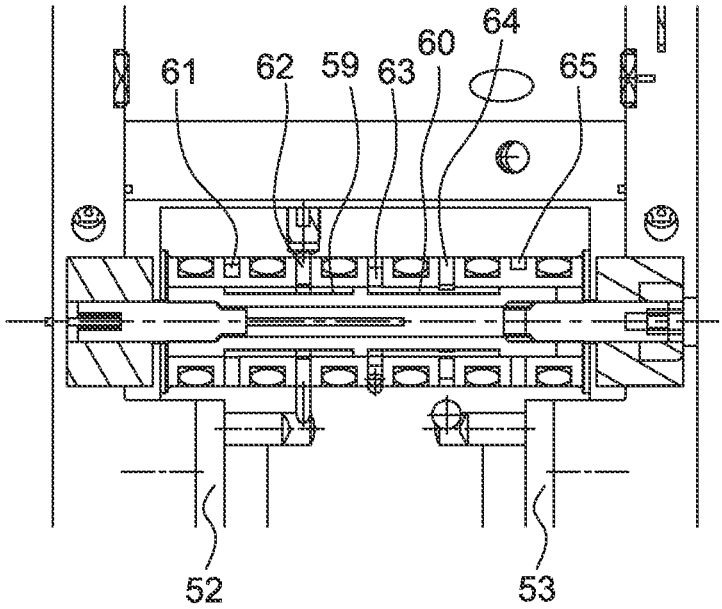

FIGS. 7*a* and 7*b* show two positions of the rod 58 inside the bore 56. The two chambers 52 and 53 communicate permanently with the communication chambers 59 and 60, respectively, and the movement of the rod 58 makes it possible to connect each communication chamber 59 and 60 either with the high-pressure fluid P present in the channel 63 or with the low-pressure fluid T present in the channels 61 and 65.

In FIG. 7*a*, the position shown as 55*a* is termed the position of equilibrium as neither the high-pressure fluid nor the low-pressure fluid communicates with the chambers 52 and 53. In this position the excentricity E remains constant. More precisely, the three cylindrical shapes of diameter D block the low-pressure channels 61 and 65 and the high-pressure channel 63. The chambers 52 and 53 communicate only with the communication chambers 59 and 60, respectively, with access to neither the high-pressure fluid nor the low-pressure fluid.

In FIG. 7*b*, the rod 58 is moved to the left in the figure. This is position 55*b*. The central cylindrical shape of diameter D frees up access to the channel 63 and the high-pressure fluid P communicates with the communication chamber 60. Similarly, the left-hand cylindrical shape D frees up access to the channel 61. The low-pressure fluid T communicates with the communication chamber 59 and the chamber 52. The carriage 48 moves to the left. A movement of the carriage 48 in the opposite direction is possible with a movement of the rod 58 to the right in order to reach the position 55*c*.

The movement of the rod 58 is, for example, effected by means of a winding 70 supplied with a control electric current. A core 71 integral with the rod 58 moves in the winding 70 as a function of the control current.

Another advantage linked with forming the valve 55 in the carriage 48 is the creation of an automatic control of the excentricity E of the carriage 48 relative to the control.

More precisely, a movement of the rod 58 by the value of the desired excentricity E relative to the casing 14 brings certain channels 61, 63 or 65 into communication with the corresponding communication chambers 59 and 60. When the carriage 48 reaches the desired excentricity E, the relative position of the rod 58 with respect to the carriage 48 causes the rod 58 to assume the position 55*a*, shown in FIG. 7*a*, without there being any need for a new control to be applied to the winding 70.

The converter comprises a sensor 72 that allows its excentricity E to be determined. To this end, the sensor 72 measures the position of the rod 58 relative to the casing 14. When the rod 58 is in its position of equilibrium, that shown in FIG. 7*a*, the measurement made by the sensor 72 is the position of the carriage 48. When the rod 58 is in one of its extreme positions, as shown in FIG. 7*b*, the measurement made by the sensor 72 is the position of the carriage 48 plus the movement of the rod 58 relative to the carriage 48. The movement of the rod 58 relative to the carriage 48 is relatively fleeting. Indeed, the valve 55 quickly resumes its central position 55*a* after a control is applied to the winding 70. As a first approximation, it can therefore be considered that the sensor 72 measures the excentricity E of the converter. This excentricity E is proportional to the output of the converter and hence to the speed of movement of a load moved by the fluid delivered by the converter.

Moreover, knowing the variation in the acceleration of the load, which is referred to as "jerk", is important when the converter is applied to the production of a humanoid robot in order to mimic the working of the human body. Indeed, it has been observed that human beings tend to minimize any jerking in their movements. Knowing the variation in the acceleration of the load makes it possible, in a control strategy of the converter, to control the jerk and thus mimic human behavior.

The converter advantageously comprises means for determining the acceleration of the output of the converter from the control of the valve 55. More precisely, the variation in the position of the rod 58 is proportional to the control signal applied to the winding 70. The control signal is thus proportional to the acceleration of the load. By varying the control signal over time, the acceleration of the output of the converter, or the jerk, is thus obtained.

An LVDT (Linear Variable Differential Transformer) sensor is, for example, used.

The fluid used to move the carriage 48 can originate from a source outside the converter. This solution makes it possible to simplify the supply to the valve 55 by using an external source in which the high and low pressures P and T have constant pressures. This solution nevertheless has the disadvantage of requiring additional lines to supply the valve 55 with fluid. In order to overcome this problem, the pressure prevailing in the grooves 40 and 41 is used to move the carriage 48. This improves the independence of the converter with respect to its surroundings.

To this end, the converter comprises a distributor 75 to bring the high-pressure inlet P of the valve 55 into communication with the groove 40 or 41 in which the pressure of the fluid is greatest and to bring the low-pressure inlet T of the valve 55 into communication with the groove 40 or 41 in which the pressure of the fluid is lowest.

To aid understanding of the operation of the distributor 75, an electrical analogy can be made with the hydraulic functioning of the distributor 75. In this analogy, the pressure delivered by the grooves 40 and 41 is compared to an alternating voltage since the excentricity E can be positive or negative. The distributor 75 then behaves like a voltage rectifier allowing the valve 55 to be supplied between positive and negative electrical terminals of the rectifier.

Figure 8:
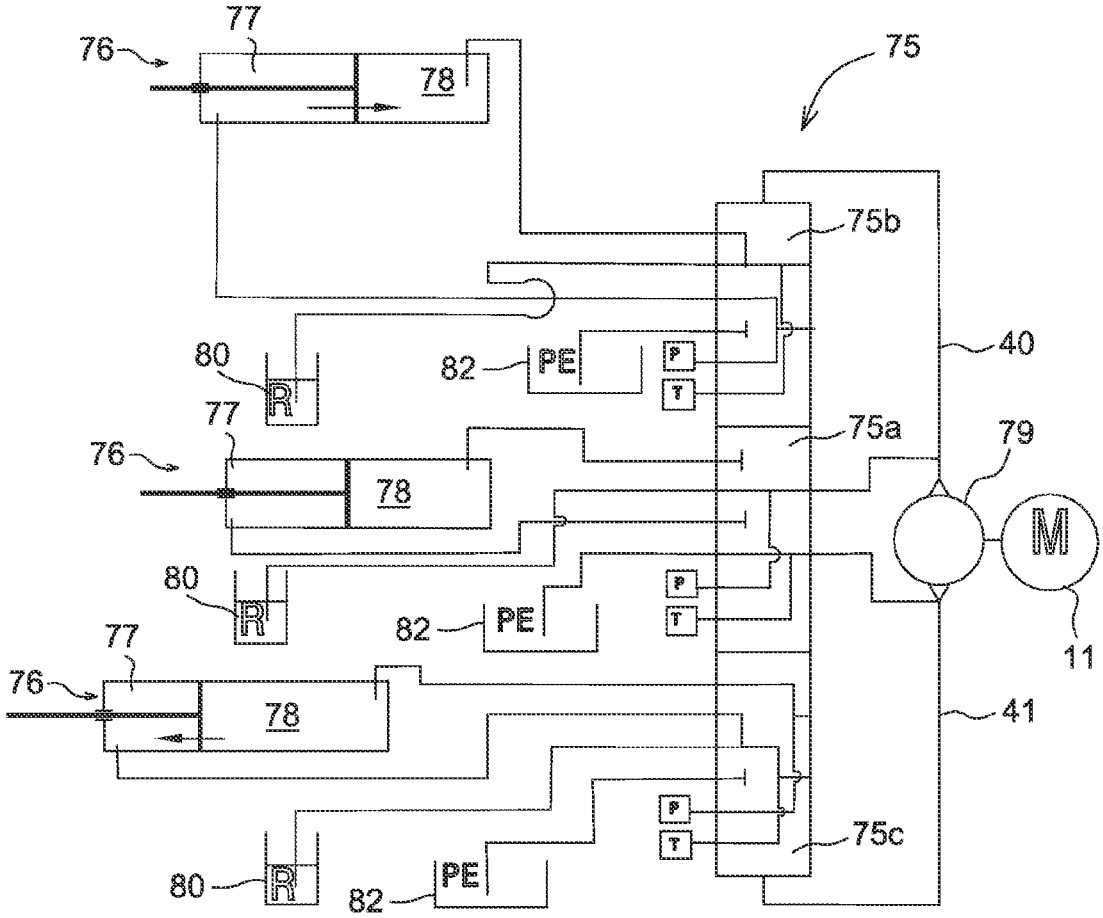
FIG. 8 shows a hydraulic diagram of a distributor of a first alternative embodiment of the converter.

FIG. 8 shows a hydraulic diagram of the distributor 75 supplied by the fluid present in the groove 40 and by the fluid present in the groove 41. The distributor 75 can assume three positions. In a central position 75*a*, the excentricity E is zero and the pressure of the fluid in the groove 40 is equal to the pressure of the fluid in the groove 41. In this position, the distributor 75 connects the groove 40 to the inlet P of the valve 55 and the groove 41 to the inlet T of the valve 55. A load 76 supplied by the converter is shown in the form of a dual-action cylinder comprising two chambers 77 and 78. In the central position 75*a*, neither of the chambers of the load 76 is supplied. When the excentricity E is modified in such a way that the pressure in the groove 41 is greater than the pressure in the groove 40, the distributor 75 moves into a second position labeled 75*b* in which the groove 40 is connected to the low-pressure inlet T and the groove 41 is connected to the high-pressure inlet P of the valve 55. The pressure difference between the two grooves 40 and 41 is created by pumping means 79 of the converter including, notably, the pistons 23 to 25 described above. Furthermore, in the position 75*b*, the chamber 77 of the load 76 is connected to the groove 41 and the chamber 78 is connected to a reservoir 80 of fluid labeled R. On the other hand, when the excentricity E is modified in such a way that the pressure in the groove 40 is greater than the pressure in the groove 41, the distributor 75 moves into a third position labeled 75*c* in which the groove 41 is connected to the low-pressure inlet T and the groove 40 is connected to the high-pressure inlet P of the valve 55. Furthermore, in the position 75*c*, the chamber 78 of the load 76 is connected to the groove 40 and the chamber 77 is connected to a reservoir 80 of fluid labeled R in FIG. 8. The distributor 75 does not use any external energy source for its movements. Indeed, it is the pressure of the fluid present in the grooves 40 and 41 that allows the distributor to move from one position to another.

The converter advantageously includes means so that, when the fluid pressure between the chambers 52 and 53 is equalized, the excentricity E of the converter is not zero. These means comprise, for example, a spring situated in one of the chambers 52 or 53 and which tends to exert a force between the carriage 48 and the relevant piston 50 or 51. This spring is useful when the converter is started up. Indeed, the central position 75*a* is a position of equilibrium obtained for a zero excentricity E. Beyond this position, in the absence of the abovementioned means, the movement of the rod 58 could cause no movement of the carriage 48. By shifting the position of equilibrium of the carriage 48, this risk is avoided at start-up.

In mechanisms using hydraulic fluids, attempts are generally made to minimize leakages as much as possible so as to prevent fluid from escaping from the mechanism and to improve its performance. In the present invention, it is accepted that leakages occur in the different hydraulic functions of the converter such as, for example, the pumping means 79, the valve 55 and the distributor 75. By accepting that leakages will occur inside the converter, any impacts or, more generally, unforeseen forces that may arise on the load 76, can be damped. This damping makes it possible to mimic human behavior in the case of the converter being implemented in a humanoid robot. To this end, provision may be made for leakages internal to the converter to be adjusted to suit.

The converter advantageously includes means for recycling any internal fluid leakages that take place, notably during pumping. These leakages are collected in an internal hydraulic space 82 labeled PE in FIG. 8. The internal hydraulic space 82 is situated inside the casing 14, notably on either side of the carriage 48.

To this end, the distributor 75 includes means so that, when it leaves its central position 75*a*, the groove in which the pressure is lowest, here the groove 41, is connected to the internal hydraulic space 82 collecting internal leakages of the converter as long as the channels supplying the load 76 remain closed off by the distributor 75.

Continuing the electrical analogy introduced above, the rectifier, which represents the distributor, can be illustrated as a diode bridge in which the threshold voltages are different: an increased threshold voltage toward a negative voltage representing reduced pressure, and a reduced threshold voltage toward a positive voltage representing excess pressure. Leakages are recycled as long as the alternating voltage is less than the threshold voltage. In the hydraulic diagram in FIG. 8, the means for recycling leakages cannot be seen as the internal hydraulic space 82 is connected to one of the grooves only in the central position 75*a*.

Figure 9:
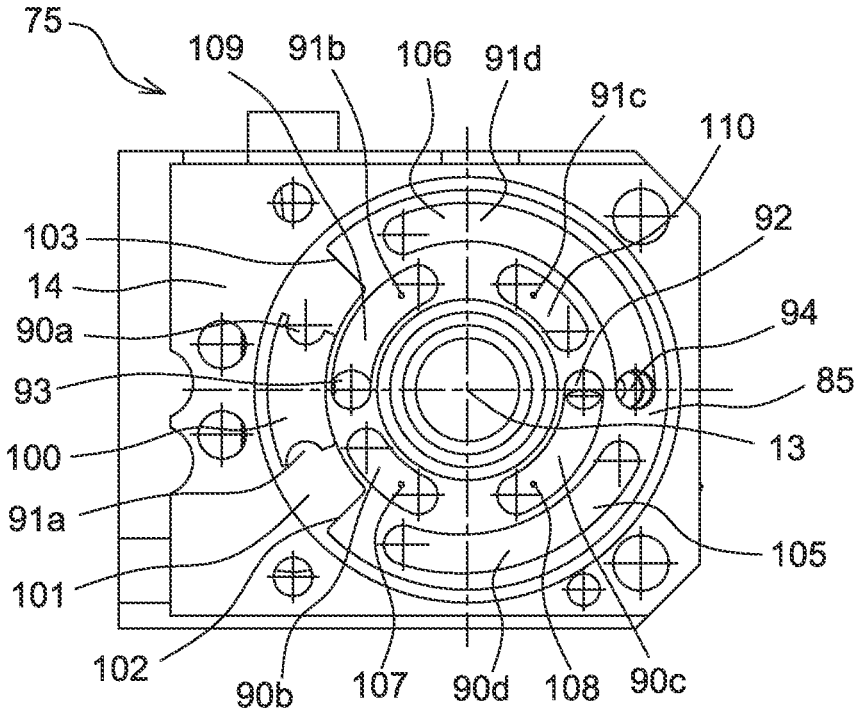
FIGS. 9 and 10 show an embodiment of the distributor in FIG. 8; these two figures are cross sections along perpendicular planes.
Figure 10:
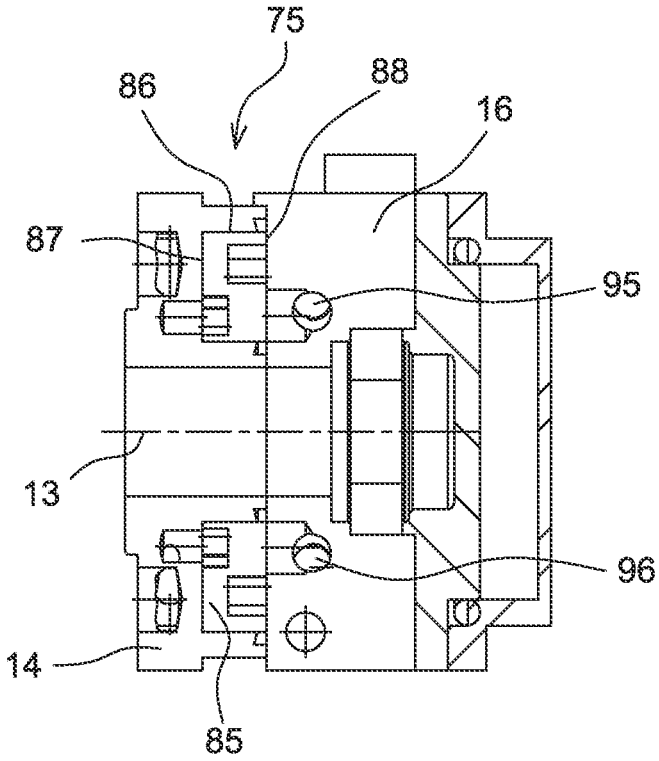

FIGS. 9 and 10 show an embodiment of a distributor that makes it possible both to supply the valve 55 and recycle the leakages. The distributor 75 includes a movable part, termed a throttle valve 85, that can freely rotate about the axis 13 inside the casing 14. The throttle valve 85 has the shape of a flat disk. The throttle valve 85 is guided in rotation between an annular cavity 86 of the casing 14 and a complementary annular shape of the throttle valve 85. The annular cavity 86 is limited by two faces 87 and 88 of the casing 14 that are perpendicular to the axis 13. The face 88 belongs to the cover 16. The groove 40 communicates with orifices 90*a*, 90*b*, 90*c* and 90*d* of the face 87 and the groove 41 communicates with orifices 91*a*, 91*b*, 91*c* and 91*d* of the face 87. The channels 61 and 65, forming the low-pressure inlet T of the valve 55, communicate with an orifice 92 of the face 88 and the channel 63 forming the high-pressure inlet P of the valve 55 communicates with an orifice 93 of the face 88. The fluid reservoir 80 communicates with an orifice 94 of the face 88. Two orifices 95 and 96 situated on the face 88 form outlets of the converter that allow the load 76 to be supplied. Furthermore, to recycle the leakages, the face 87 includes an orifice 97 that can be seen in FIGS. 11*a* to 11*g* communicating with the internal hydraulic space 82.

The casing 14 includes an abutment 100 limiting the rotation of the throttle valve 85. The throttle valve 85 includes an annular groove 101, the ends 102 and 103 of which can bear against the abutment 100. The bearing of one of the ends 102 or 103 against the abutment 100 depends on the pressure difference of the fluid present in the grooves 40 and 41. By way of example, around the central position 75*a*, the throttle valve 85 can cover an angular sector of + or −22.5° about the axis 13.

The throttle valve 85 includes multiple annular counterbores communicating with the fluid issuing from the grooves 40 and 41. On a large diameter of the throttle valve 85 a counterbore 105 is permanently situated opposite the orifice 90*d*. On a large diameter of the throttle valve 85 a counterbore 106 is permanently situated opposite the orifice 91*d*. On a small diameter of the throttle valve 85 two counterbores 107 and 108 are permanently situated opposite the orifices 90*b* and 90*c*. On a small diameter of the throttle valve 85 two counterbores 109 and 110 are permanently situated opposite the orifices 91*b* and 91*c*. "Permanently situated" is understood to mean that the counterbore and the orifice in question face each other in all positions of the throttle valve 85 in its rotational movements about the axis 13. In other words, the counterbores 105, 107 and 108 contain fluid at the pressure in the groove 40 and the counterbores 106, 109 and 110 contain fluid at the pressure in the groove 41.

In FIG. 9, the throttle valve 85 is shown in the central position 75*a*. In its rotation about the axis 13, the throttle valve 85 allows or closes off the passage of the fluid between orifices in the face 87 and orifices in the face 88. The different positions that the throttle valve 85 can assume, as well as the communications between orifices, are shown in FIGS. 11*a* to 11*g*.

Figure 11A:
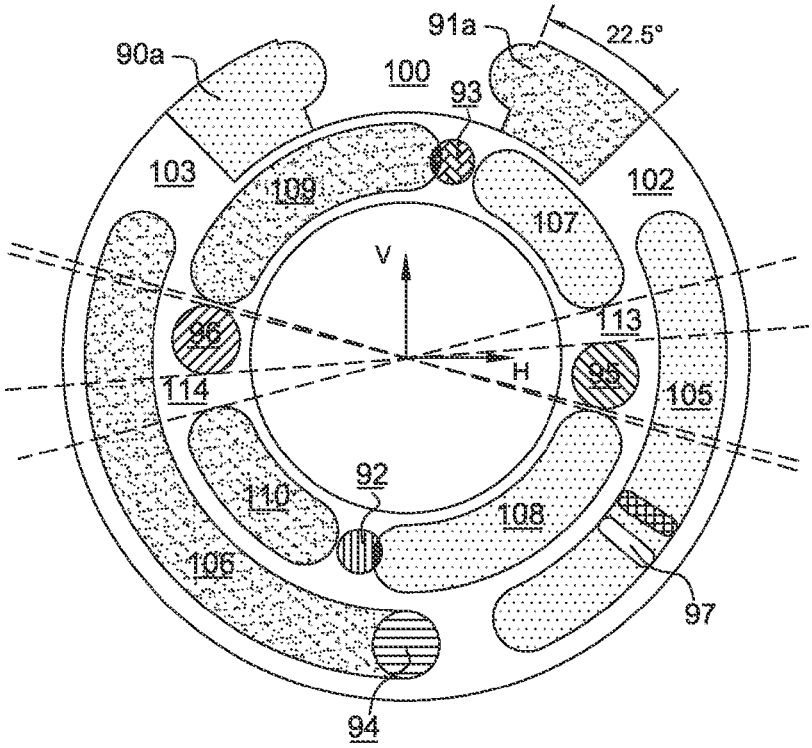
FIGS. 11*a* to 11*g* show different positions of a movable part of the distributor of the first embodiment.

FIG. 11*a* shows the throttle valve 85 in the central position 75*a*. In this position, the orifices 95 and 96 allowing the load 76 to be supplied are closed off by the solid parts 113 and 114 of the throttle valve 85 situated respectively between the counterbores 107 and 108, on the one hand, and 109 and 110, on the other hand. The orifices 92 and 93 communicate partly with the counterbores 108 and 109, respectively, such that the valve 55 is supplied. The orifice 94 connected to the reservoir 80 communicates with the counterbore 106 and the orifice 97 allowing the leakages to be recycled is completely closed off. The end 102 is at an angular position of 22.5° relative to the abutment 100.

Figure 11B:
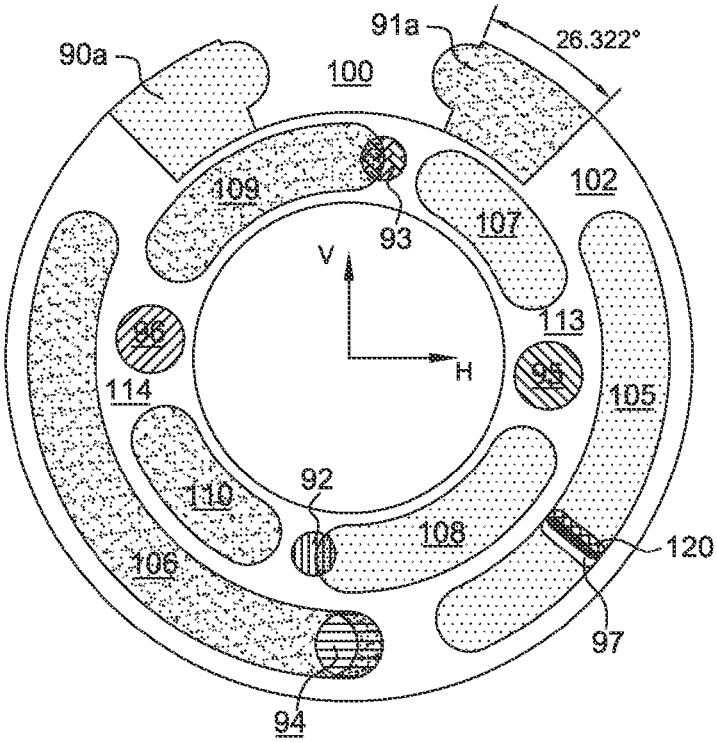

FIG. 11*b* shows the throttle valve 85 in a position in which the pressure of the fluid in the groove 41 is slightly greater than that of the fluid present in the groove 40. As in FIG. 11*a*, the orifices 95 and 96 allowing the load 76 to be supplied are closed off by the solid parts 113 and 114 of the throttle valve 85. The orifices 92 and 93 communicate partly with the counterbores 108 and 109, respectively, such that the valve 55 is supplied. The orifice 94 connected to the reservoir 80 communicates with the counterbore 106. The orifice 97 allowing the leakages to be recycled communicates partly with the counterbore 105 via an orifice 120 traversing the bottom of the counterbore 105. As a consequence, the fluid contained in the internal hydraulic space 82 communicates with the groove 40 which is at a reduced pressure. The content of the internal hydraulic space 82 is drawn by the pumping of the converter into the reservoir 80. The position of the throttle valve 85 shown in FIG. 11*b* is an intermediate one between the position 75*a* and 75*c b*. The end 102 is at an angular position of 26.32° relative to the abutment 100.

Figure 11C:
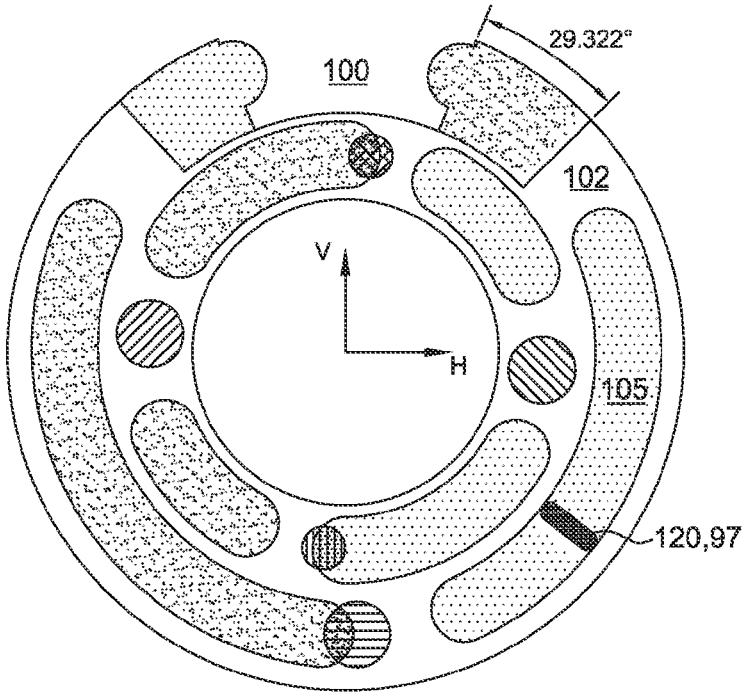

FIG. 11*c* shows the throttle valve 85 in a position in which it is moved from the position in FIG. 11*a* toward the position 75*b* in such a way that the orifices 97 and 120 are completely facing each other and the recycling of the leakages is at its maximum. The position of the throttle valve 85 shown in FIG. 11*c* is an intermediate one between the position in FIG. 11*b* and the position 75*b*. The end 102 is at an angular position of 29.32° relative to the abutment 100.

Figure 11D:
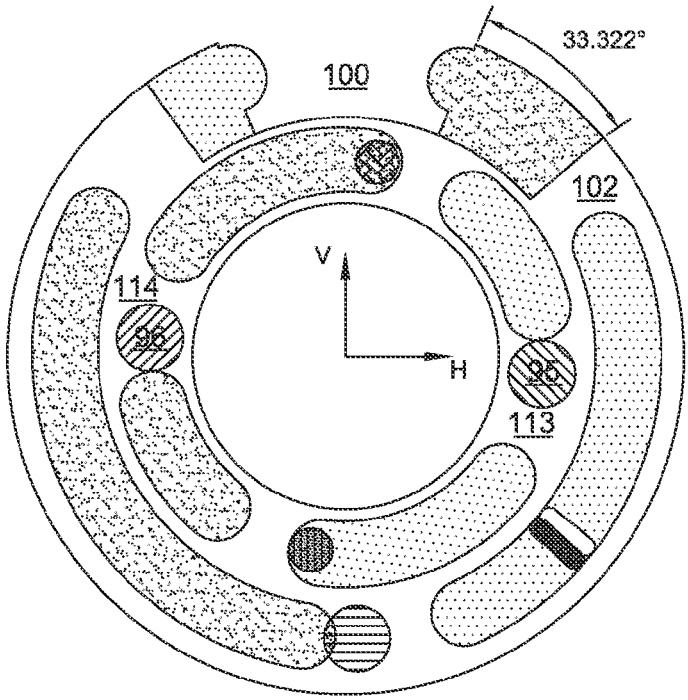

FIG. 11*d* shows the throttle valve 85 in a position in which it is moved between the position in FIG. 11*b* and the position 75*b* in such a way that the orifices 97 and 120 no longer face each other. The leakages are no longer sucked up. In this position, the orifices 95 and 96 allowing the load 76 to be supplied are still closed off by solid parts 113 and 114 of the throttle valve 85. Attempts are made to suck up the leakages as long as the converter is not supplying the load 76. The end 102 is at an angular position of 33.32° relative to the abutment 100.

Figure 11E:
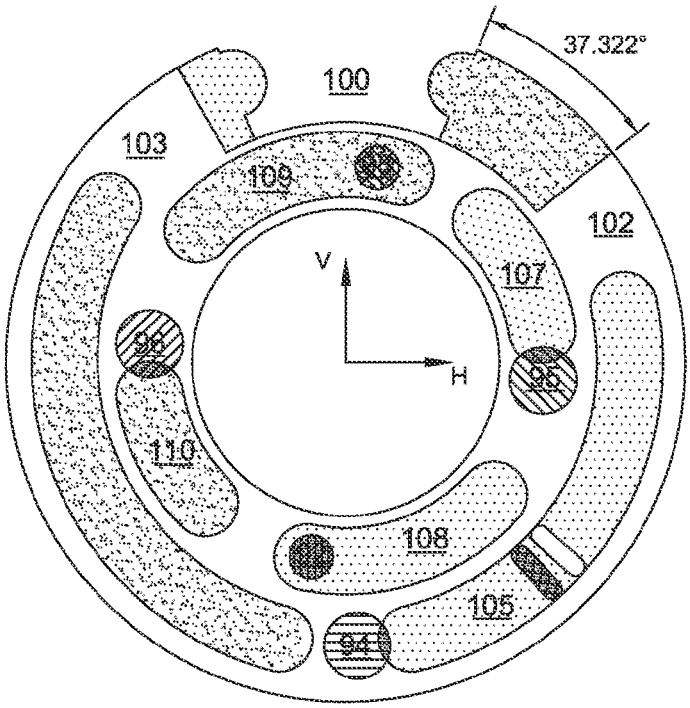

FIG. 11*e* shows the throttle valve 85 almost in the position 75*b*. In this position, the orifices 95 and 96 allowing the load 76 to be supplied come into communication with the counterbores 107 and 110, respectively, and the orifice 94 comes into communication with the counterbore 105 so as to supply the load between the highest pressure delivered by the converter and the reservoir 80. The end 102 is at an angular position of 37.32° relative to the abutment 100.

In the position 75*b*, not shown, the end 103 comes into contact with the abutment 100 and the orifices 95 and 96 allowing the load 76 to be supplied are completely in communication with the counterbores 107 and 110, respectively. The orifice 94 is also completely in communication with the counterbore 105.

Figure 11F:
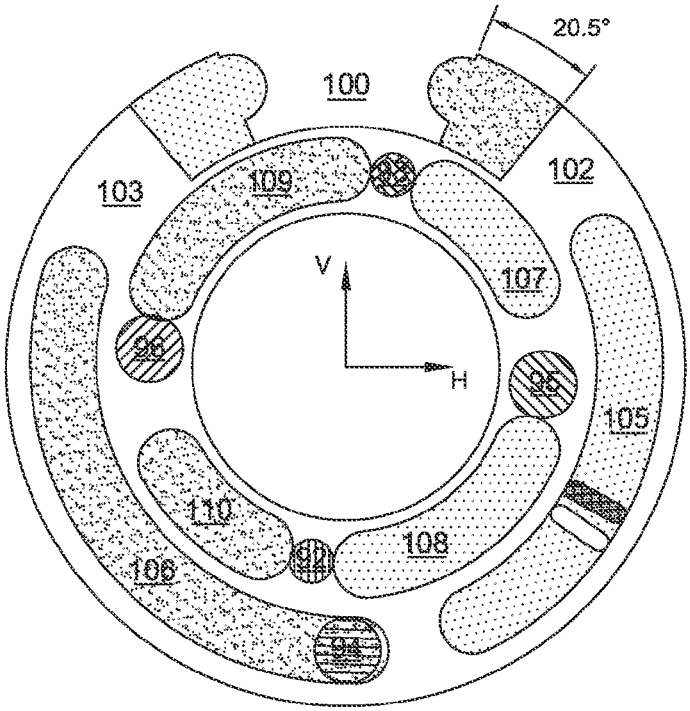

FIG. 11*f* shows the throttle valve 85 in an intermediate position between the central position 75*a* shown in FIG. 11*a* and the position 75*c*. In this position, the orifices 95 and 96 allowing the load 76 to be supplied come into communication with the counterbores 108 and 109, respectively, and the orifice 94 remains in communication with the counterbore 106 so as to supply the load 76 between the high pressure delivered by the converter and the reservoir 80. The end 102 is at an angular position of 20.5° relative to the abutment 100. In this position, the orifices 92 and 93 are not completely closed off so as to allow the valve 55 to be supplied.

Figure 11G:
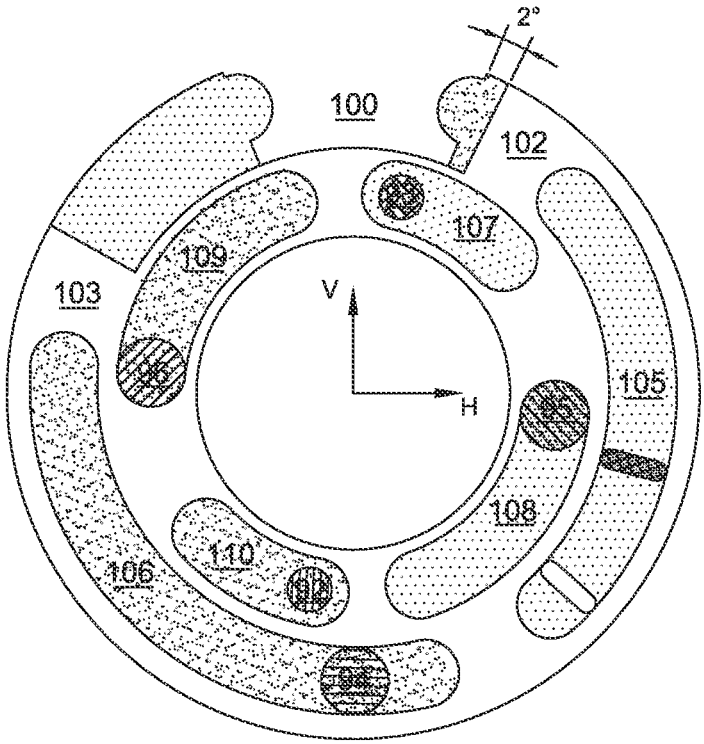

In the position 75*c*, shown in FIG. 11*g*, the end 102 comes into contact with the abutment 100 and the orifices 95 and 96 allowing the load 76 to be supplied are completely in communication with the counterbores 108 and 109, respectively. The orifice 94 is also completely in communication with the counterbore 106. The orifices 92 and 93 supplying the valve 55 communicate with the counterbores 110 and 107, respectively.

The converter advantageously comprises means for storing the hydraulic energy in a pressurized reservoir 119. The storage can take place when the load 76 has to remain stationary. In an application as a humanoid robot, the use of a load such as a cylinder for moving, for example, an ankle follows an operating cycle in which rest periods alternate with working periods. It is possible to simulate the walking of the robot and thus predefine a cyclic ratio between the working periods and the rest periods of the ankle. The storage of hydraulic energy takes place during the rest periods and it is possible to dimension the pressurized reservoir 119 as a function of a cyclic ratio between the working periods and the rest periods of the cylinder.

The pressurized reservoir 119 is advantageously shared by several converters of the robot. Converters can be chosen in which the working periods do not overlap in time and, for example, converters in which the cycles are opposite. This is, for example, the case with the two ankles of the robot. Thus, when one of the converters stores energy in the reservoir 119, another converter associated with the same reservoir 119 uses this energy. The dimensions of the shared reservoir 119 can thus be reduced.

Figure 12A:
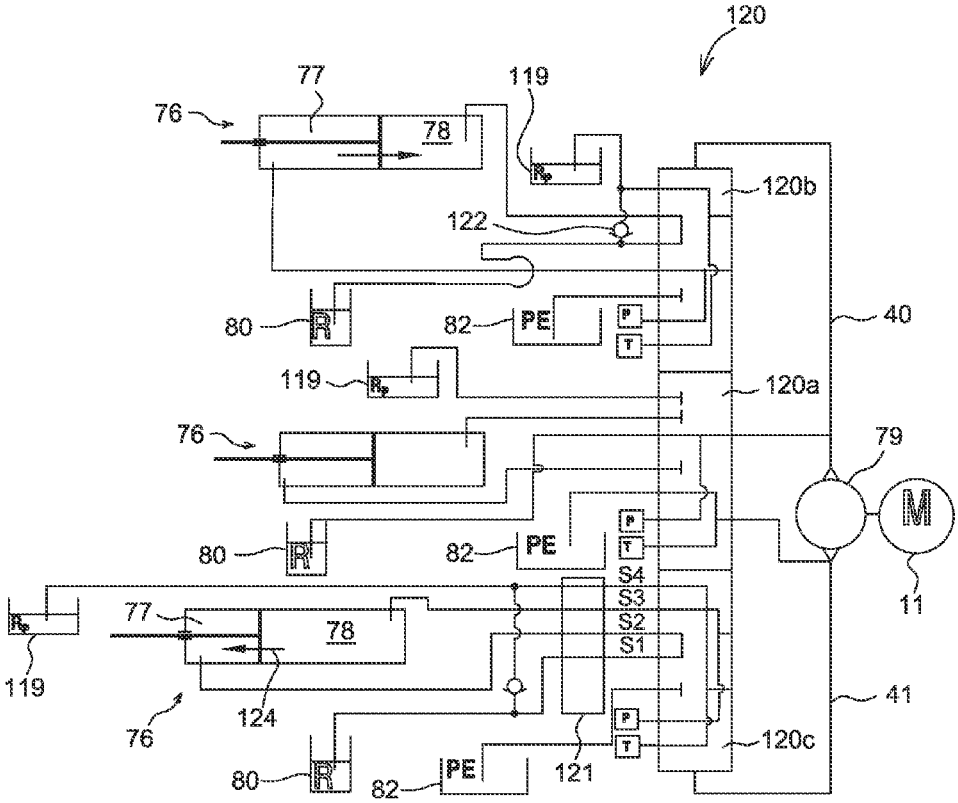
FIGS. 12*a* and 12*b* show a hydraulic diagram of two distributors of a second alternative embodiment of the converter.
Figure 12B:
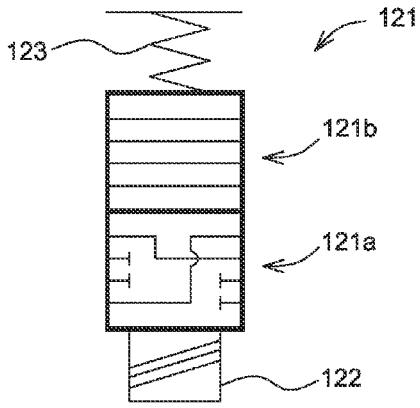
Figure 13:
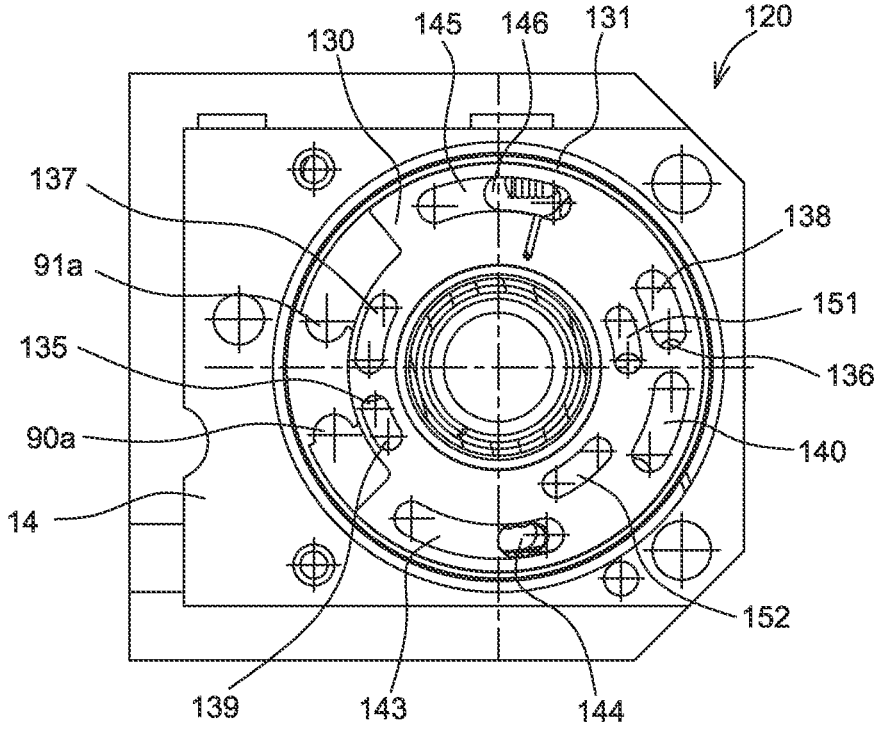
FIGS. 13 and 14 show an embodiment of the distributors in FIGS. 12*a* and 12*b;*
Figure 14:
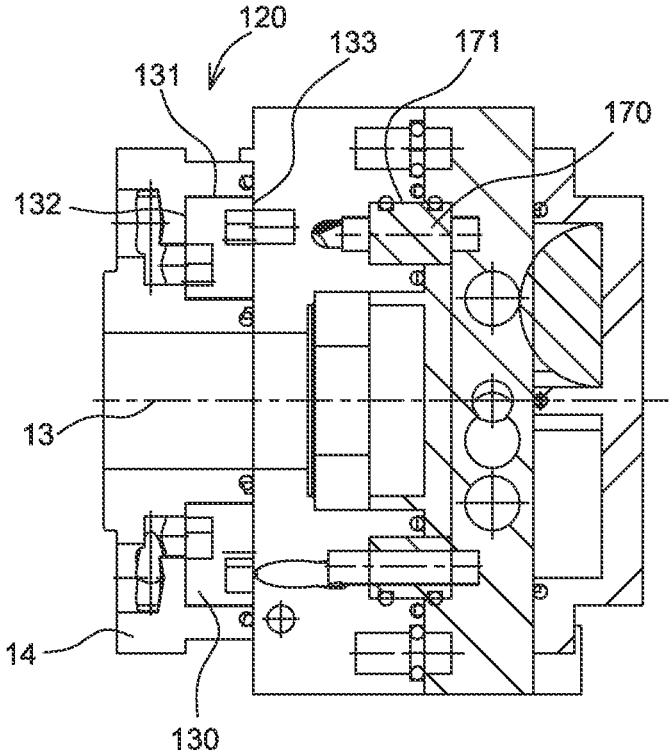
Figure 15A:
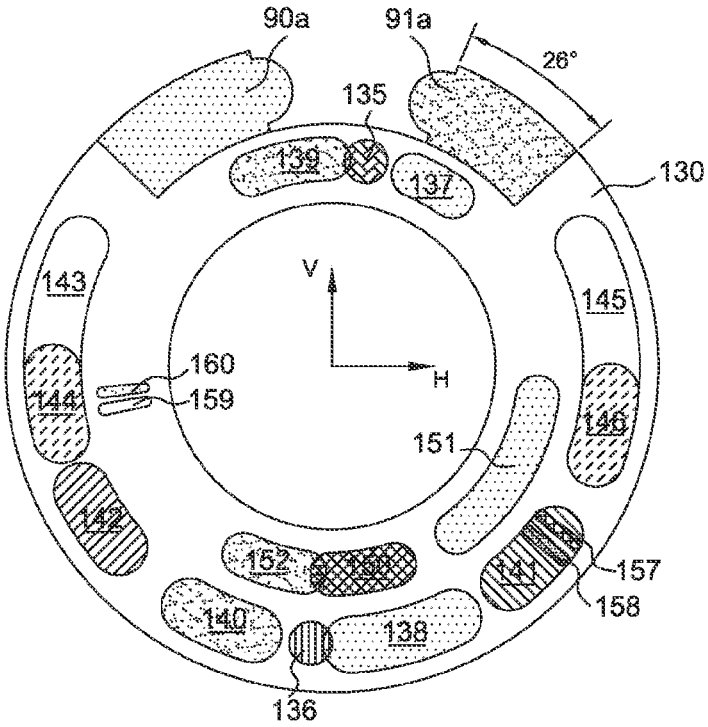
FIGS. 15*a* to 15*g* show different positions of a movable part of the first distributor of the second alternative embodiment.
Figure 15B:
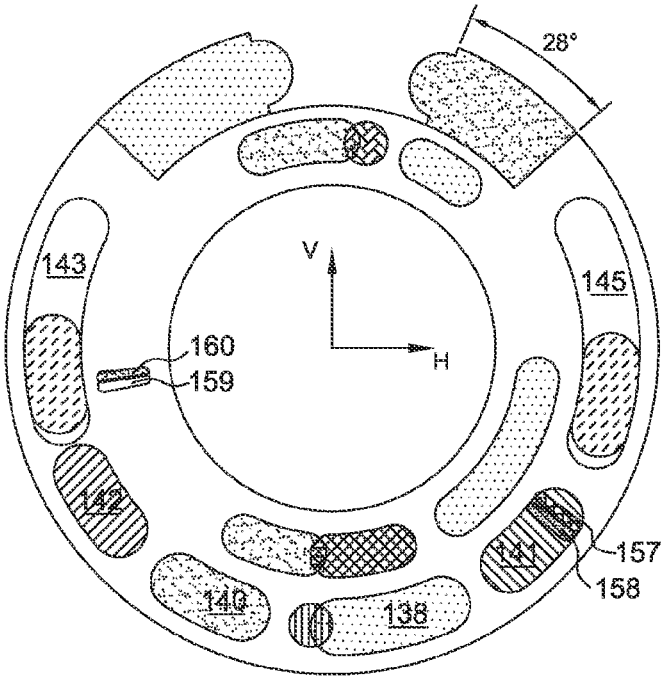
Figure 15C:
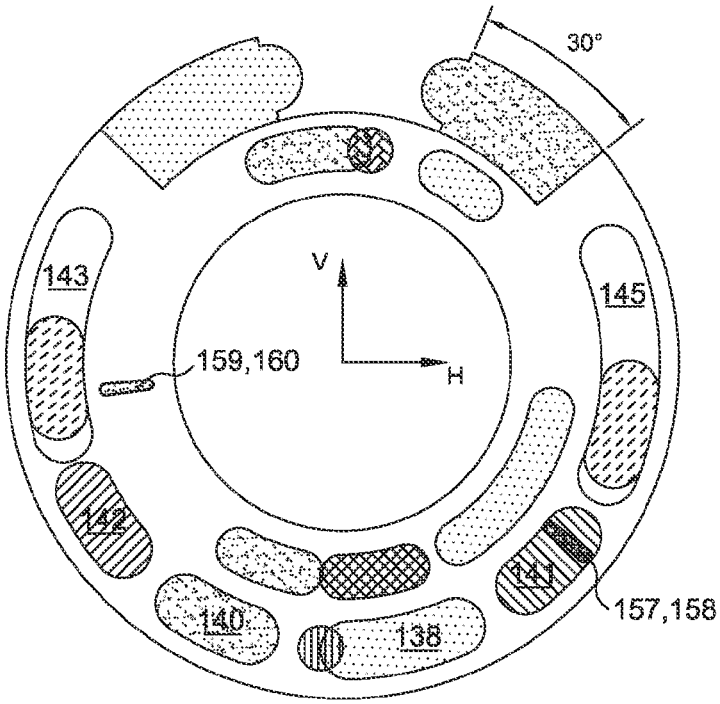
Figure 15D:
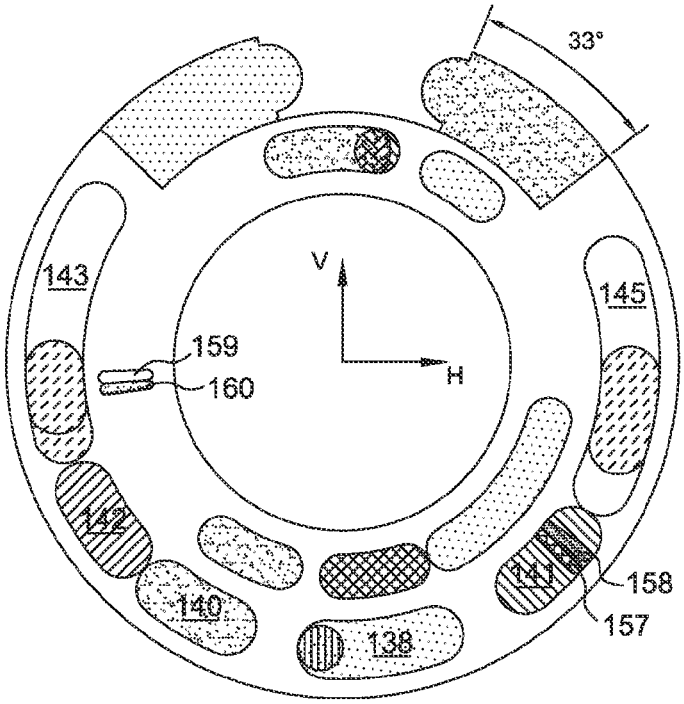
Figure 15E:
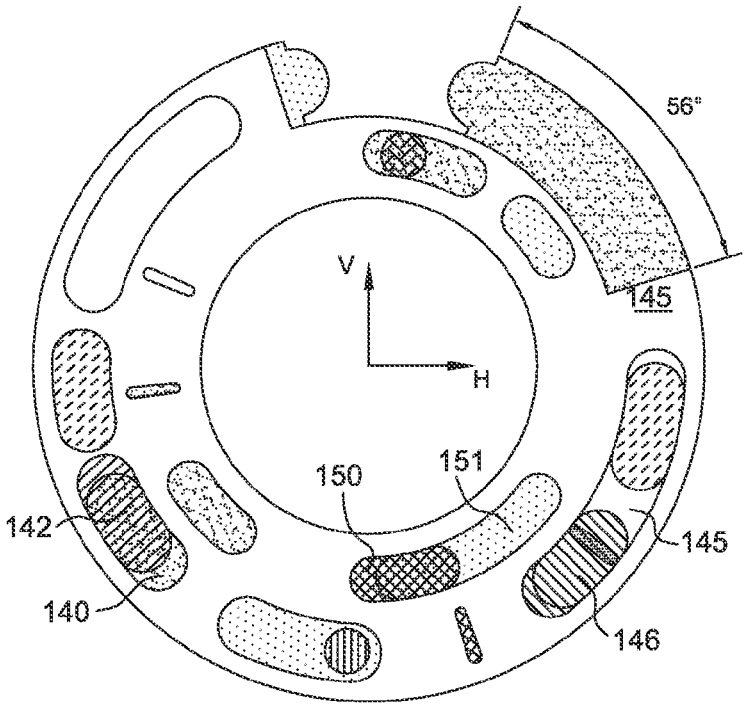
Figure 15F:
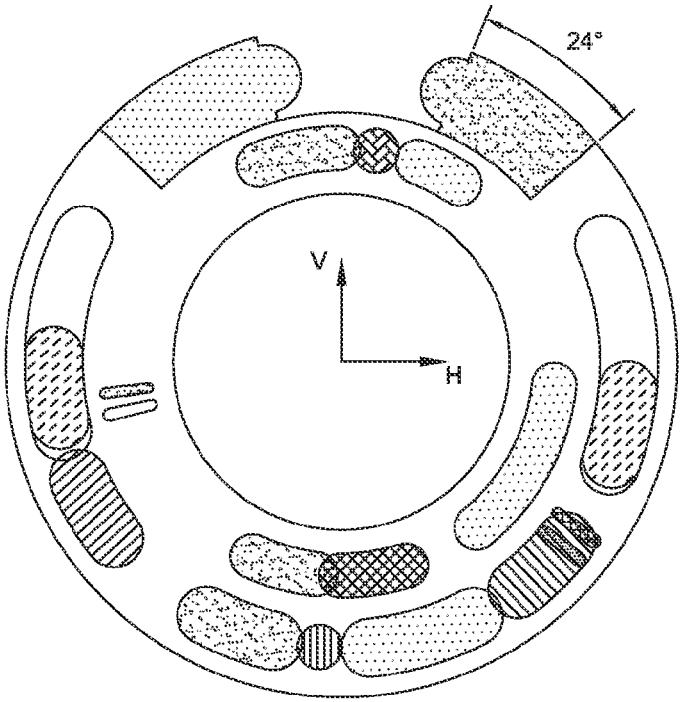
Figure 15G:
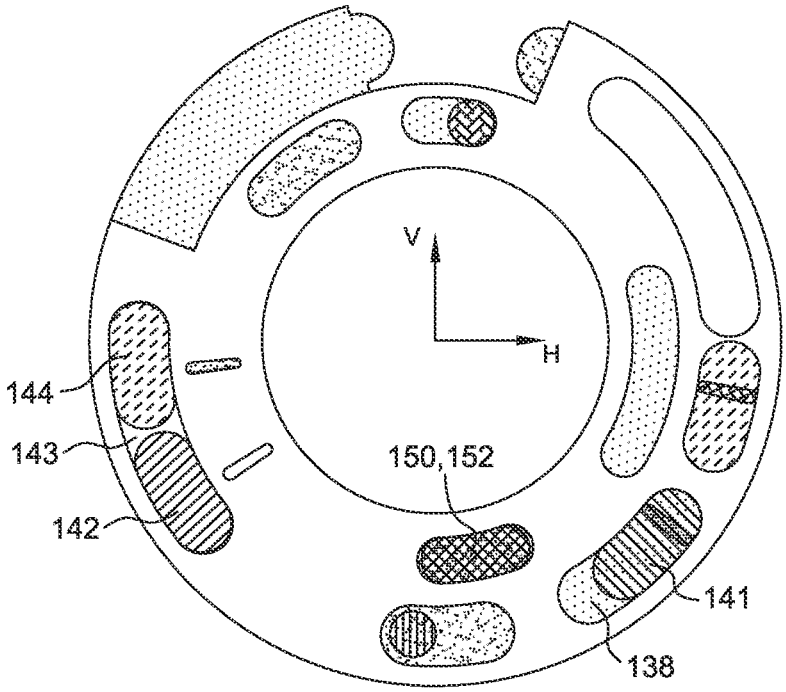
Figure 16A:
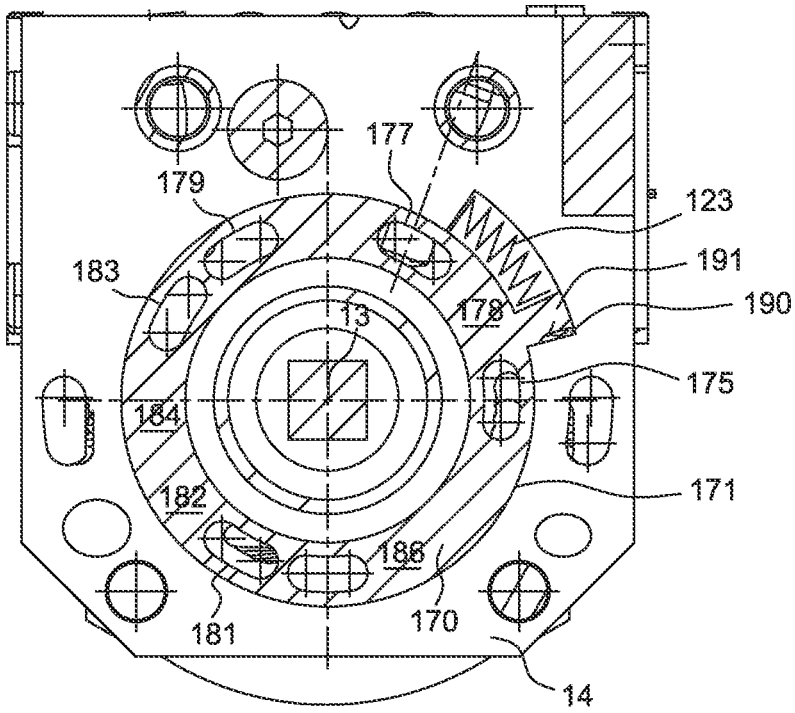
Figure 16A:
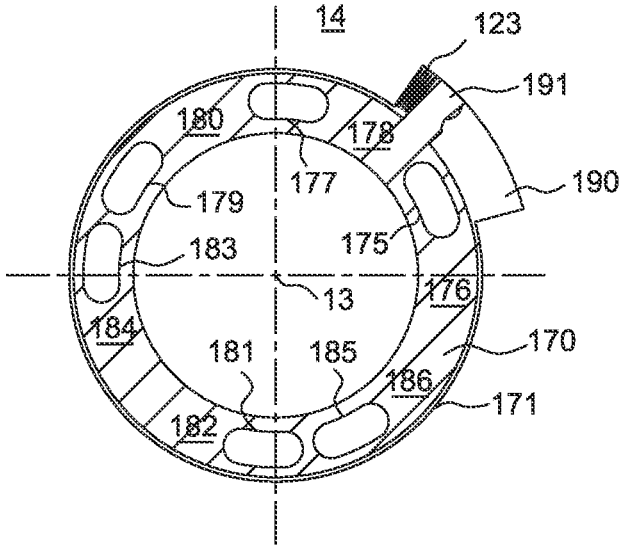

An alternative embodiment allowing an example of means for storing hydraulic energy to be illustrated is shown with the aid of FIGS. 12*a* and 12*b* for a hydraulic diagram, FIGS. 13 and 14 for an embodiment, FIGS. 15*a* to 15*g* for the different positions of a throttle valve of a first distributor 120 and FIGS. 16*a* and 16*b* for the different positions of a throttle valve of a second distributor 121.

The distributor 120, like the distributor 75, is supplied by the grooves 40 and 41 and supplies the chambers 77 and 78 of the load 76, the valve 55 via its high-pressure inlet P and low-pressure inlet T. The distributor 120 can assume three positions 120*a*, 120*b* and 120*c*. The position 120*a* is identical to the position 75*a*.

In the position 120*b*, the pressure in the groove 41 is greater than that in the groove 40. The high-pressure inlet P and low-pressure inlet T of the valve 55 are, as for the position 75*b*, supplied by the grooves 41 and 40, respectively. Similarly, as for the position 75*b*, the chamber 77 is supplied by the groove 41. However, unlike the distributor 75, in the position 120*b*, the chamber 78 is connected to the reservoir 80 without any link to the pumping means 79 and the groove 40 draws the fluid into the pressurized reservoir 119. A check valve 122 ensures that the pressure of the pressurized reservoir 119 is never less than the pressure of the reservoir 80 which is, for example, maintained at atmospheric pressure.

In the position 120*c*, the pressure of the groove 40 is greater than that of the groove 41. The high-pressure inlet P and low-pressure inlet T of the valve 55 are, as for the position 75*c*, supplied by the grooves 40 and 41, respectively. On the other hand, the load 76 and the reservoirs 80 and 119 are not connected directly to the distributor 120 but via the distributor 121, the hydraulic diagram of which is shown in FIG. 12*b*.

The distributor 121 can assume two positions, 121*a*, termed the rest position, and 121*b*, termed the active position. The distributor 121 is controlled by an external actuator 122, for example an electric actuator. In the absence of any control of the actuator 122, the distributor 121 is returned to its rest position by means of a spring 123.

In the position 121*a*, the two chambers 77 and 78 of the load 76 are isolated and the pumping means 79 draw fluid into the reservoir 80 in order to increase the pressure of the pressurized reservoir 119.

The actuator 122 is activated when it is desired to move the load in the direction represented by an arrow 124. When the actuator 122 is activated, the distributor 121 assumes the position 121*b*, the chamber 77 is connected to the reservoir 80 and the pumping means 79 draw fluid from the pressurized reservoir 119 to supply the chamber 78. The pressure difference between the two chambers 77 and 78 is thus equal to the sum of the pressure difference between the two reservoirs 80 and 119 and the pressure difference obtained by the pumping means 79. Thus, when the load 76 is at rest, energy can be stored by increasing the pressure of the pressurized reservoir 119. This stored energy is recovered when the load 76 is moved either in the position 120*b* or in the position 120*c*, these two positions being associated with the position 121*b*. When all the stored energy has been consumed, the pressure of the reservoir 119 becomes equal to that of the reservoir 80 and the operation of the converter reverts to that of the alternative embodiment implementing the distributor 75.

To form the storage means, the distributor 120 includes a throttle valve 130, freely rotatable about the axis 13 inside the casing 14. The throttle valve 130, like the throttle valve 85, is guided in rotation in an annular cavity 131 of the casing 14. The annular cavity 131 is limited by two faces 132 and 133 of the casing 14 that are perpendicular to the axis 13. The throttle valve 130 is shown in different positions in FIGS. 15*a* to 15*g*.

Like the distributor 75, the distributor 120 allows the high-pressure inlet P of the valve 55 to be brought into communication with the groove 40 or 41 in which the pressure of the fluid is greatest and the low-pressure inlet T of the valve 55 to be brought into communication with the groove 40 or 41 in which the pressure of the fluid is lowest. To this end, the distributor includes orifices 135 and 136 connected to the channel 63, forming the high-pressure inlet P of the valve 55, for the orifice 135, and to the channels 61 and 65, forming the low-pressure inlet T of the valve 55, for the orifice 136. As a function of the rotation of the throttle valve 130, the orifices 135 and 136 communicate either with counterbores 137 and 138 connected to the groove 40 via the orifice 90*a* or with counterbores 139 and 140 connected to the groove 41 via the orifice 91*a*.

The distributor 120 also makes it possible to bring the chambers 77 and 78 of the load 76 into communication with the grooves 40 and 41 via the distributor 121 when the latter is in its position 121*b*. To simplify the description of the distributor 120, it is assumed below that the distributor 121 is in its position 121*b*, in other words without the storage of any energy.

The distributor 120 includes an orifice 141 communicating either with the counterbore 138 so that the orifice 141 communicates with the groove 40 (see FIG. 15*g*), or with a counterbore 145 so that the orifice 141 communicates with the reservoir 80 via an orifice 146 of the casing 14 (see FIG. 15*e*). The distributor 120 also includes an orifice 142 communicating either with the counterbore 140 so that the orifice 142 communicates with the groove 41 (see FIG. 15*e*), or with a counterbore 143 so that the orifice 142 communicates with the reservoir 80 via an orifice 144 of the casing 14 (see FIG. 15*g*).

The pumping of the fluid from the pressurized reservoir 119 takes place by bringing an orifice 150 of the casing 14 into communication either with a counterbore 151 of the throttle valve 130 connected to the groove 40 (see FIG. 15*e*), or with a counterbore 152 of the throttle valve 130 connected to the groove 41 (see FIG. 15*g*).

Like the distributor 75, the distributor 120 allows the leakages contained in the internal hydraulic space 82 to be recycled by being drawn into the reservoir 80. The recycling is effected between the central position in FIG. 15*a* and the extreme position in FIG. 15*e*. The recycling is illustrated in the positions of the throttle valve 130 which are shown in FIGS. 15*b*, 15*c* and 15*d*. In these positions, the load 76 is isolated and the orifices 141 and 142 communicate neither with the grooves 40 and 41 via the counterbores 138 and 140 nor with the reservoir 80 via the counterbores 143 or 145.

The positions of the throttle valve 130 which are shown in FIGS. 15*b*, 15*c* and 15*d* correspond to the central position 120*a* in FIG. 12*a*. The pumping means 79 draw out the fluid contained in the internal hydraulic space 82 to deliver it into the reservoir 80. The internal hydraulic space 82 is connected to the groove 40 which is at a lower pressure than that of the groove 41. This link is made by bringing an orifice 157 of one of the faces of the casing 14 connected to the internal hydraulic space 82 into communication with a counterbore 158 of the throttle valve 130 connected to the groove 40. Furthermore, the reservoir 80 is connected to the groove 41. This link is made by bringing an orifice 159 of one of the faces of the casing 14 connected to the groove 41 into communication with a counterbore 160 of the throttle valve 130. FIG. 15*b* represents the beginning of the recycling of the leakages in the rotation of the throttle valve 130, moving away from the central position 120*a*. FIG. 15*c* represents the maximum sucking up of the leakages. In FIG. 15*c*, the orifice 157 is completely opposite the counterbore 158 and the orifice 159 is completely opposite the counterbore 160. FIG. 15*d* shows the end of the sucking up of the leakages before the load 76 is supplied.

The distributor 121 can be formed by means of a throttle valve 170 rotating about the axis 13 inside an annular cavity 171 of the casing 14. FIGS. 16*a* and 16*b* show two positions of the throttle valve 170 corresponding respectively to the positions 121*a* and 121*b* defined on the hydraulic diagram in FIG. 12*b*. The throttle valve 170 includes several elongated slots that allow orifices situated on opposite faces closing the annular cavity 171 perpendicularly to the axis 13 to be brought into communication. The spring 123, arranged between the casing 14 and the throttle valve 170, tends to return the throttle valve 170 into its position in FIG. 16*a*.

In the position 121*a* (FIG. 16*a*) an elongated slot 175 brings the reservoir 80 into communication with an outlet S1 of the distributor 120. In the position 121*b* (FIG. 16*b*), a solid part 176 of the throttle valve 170 prevents this communication.

In the position 121*a* an elongated slot 177 brings the chamber 77 of the load 76 into communication with an outlet S2 of the distributor 120. In the position 121*b*, a solid part 178 of the throttle valve 170 prevents this communication.

In the position 121*a* an elongated slot 179 brings the chamber 78 of the load 76 into communication with an outlet S3 of the distributor 120. In the position 121*b*, a solid part 180 of the throttle valve 170 prevents this communication.

In the position 121*a* an elongated slot 181 brings the pressurized reservoir 119 into communication with an outlet S4 of the distributor 120. In the position 121*b*, a solid part 182 of the throttle valve 170 prevents this communication.

In the position 121*b* an elongated slot 183 brings the pressurized reservoir 119 into communication with the outlet S3 of the distributor 120. In the position 121*a*, a solid part 184 of the throttle valve 170 prevents this communication.

In the position 121*b* an elongated slot 185 brings the reservoir 80 into communication with the outlet S4 of the distributor 120. In the position 121*a*, a solid part 186 of the throttle valve 170 prevents this communication.

The distributor 121 is controlled by the actuator 122 only in the position 120*c* of the distributor 120. It is possible to use the pressures P and T to rotate the throttle valve 170 about the axis 13 and overcome the force of the spring 123. To this end, the distributor 121 includes a chamber 190 formed in the casing 14 allowing the fluid entering this chamber to push a finger 191 of the throttle valve 170. The distributor 121 also includes a valve that can be arranged in a space 192 of the casing 14. The valve allows the inlet of the fluid to the chamber 190.

The invention claimed is:

1. A converter for converting mechanical energy into hydraulic energy, comprising:

a shaft rotated by mechanical energy about a first axis relative to a casing;

a hub defining a bore formed about a second axis, the shaft rotating in the bore, the first axis being parallel to the second axis and a distance between the first axis and the second axis defining an eccentricity;

at least two pistons movably disposed in radial housings of the shaft, each of the radial housings guiding one of the at least two pistons, the at least two pistons bearing against the bore; and a carriage disposed on the hub, the carriage configured to move along a third axis where the third axis is perpendicular to the first axis and the second axis, wherein a movement of the at least two pistons draws a hydraulic fluid from one of two annular grooves of the casing and feeds the hydraulic fluid into another of the two annular grooves, each of the two annular grooves being arranged in an arc of a circle about the first axis, a hydraulic energy being generated by a pressure difference of the hydraulic fluid present between the two annular grooves, wherein a movement of the carriage along the third axis translates the hub along the third axis to modify a value of the eccentricity between two extreme values, one extreme value being positive and another extreme value being negative, thereby enabling an inversion of fluid pressures between the two annular grooves by varying the eccentricity while maintaining a constant rotation direction of the shaft, and wherein the converter further comprises a valve for controlling the movement of the carriage by varying an amount of the fluid pressure difference between the two annular grooves that is applied to the carriage.

2. The converter as claimed in claim 1, wherein each of the at least two pistons has a form of a ball, a diameter of the ball being matched to an internal diameter of a corresponding cylinder.

3. The converter as claimed in claim 1, wherein the at least two pistons includes several pistons arranged in a quincunx pattern about the first axis.

4. The converter as claimed in claim 1, wherein the hub forms an inner ring of a rolling bearing, an outer ring of the rolling bearing being integral with the carriage.

5. The converter as claimed in claim 1, further comprising two chambers situated respectively on either side of the carriage, each of the two chambers containing the hydraulic fluid, a differential pressure of the hydraulic fluid between the two chambers causing the carriage to be moved in order to modify the eccentricity of the converter, and means for biasing the eccentricity to a non-zero value when the fluid pressure between the two chambers is equalized.

6. The converter as claimed in claim 1, wherein the valve is formed in the carriage.

7. The converter as claimed in claim 1, further comprising means for determining an acceleration of the shaft of the converter based on a valve control signal.

8. The converter as claimed in claim 1, further comprising a distributor to effect fluid communication between a high-pressure inlet of the valve and one of the two annular grooves having a pressure higher than the other of the two annular grooves, and to effect fluid communication between a low-pressure inlet of the valve and the other of the two annular grooves.

9. The converter as claimed in claim 8, wherein the distributor includes means for controlling the distributor configured to effect fluid communication between an internal hydraulic space for collecting internal leakages of the converter and one of the two annular grooves having a hydraulic fluid pressure higher than the other of the two annular grooves as long as channels of the converter supplying a load remain closed off by the distributor.

10. The converter as claimed in claim 1, further comprising means for storing the hydraulic energy in a pressurized reservoir.

11. The converter as claimed in claim 1, wherein the movement of the pistons feeds the hydraulic fluid into channels formed in the shaft, and wherein the channels communicate alternately with each of the two annular grooves of the casing.

12. The converter as claimed in claim 1, wherein each of the radial housings is a cylinder.

13. A robot, comprising:

multiple independent joints moved by hydraulic energy; and multiple converters as claimed in claim 1 coupled to the multiple independent joints, wherein a number of the multiple converters is equal to a number of the multiple independent joints, each converter being associated with one independent joint.

14. The robot as claimed in claim 13, wherein each of the multiple converters is fluidly coupled to means for storing the hydraulic energy in a pressurized reservoir, and wherein the pressurized reservoir is shared by several of the multiple converters.

* * * * *